United States Patent [19]

Marsh

[11] 4,417,420

[45] Nov. 29, 1983

[54] DOOR SEAL

[75] Inventor: Richard B. Marsh, Grosse Pointe Farms, Mich.

[73] Assignee: Marsh Industries, Inc., Mt. Clemens, Mich.

[21] Appl. No.: 233,383

[22] Filed: Feb. 11, 1981

[51] Int. Cl.[3] ..... F24C 15/02

[52] U.S. Cl. ..... 49/482; 126/190; 49/494

[58] Field of Search ..... 49/482, 494, 493, 479; 126/190; 403/408; 411/501, 500

[56] References Cited

U.S. PATENT DOCUMENTS

| | | | |
|---|---|---|---|
| 2,130,017 | 9/1938 | Lewis | 20/69 |
| 2,215,515 | 9/1940 | Matheny | 20/69 |
| 2,823,660 | 2/1958 | Holzboog et al. | 126/190 |
| 3,029,805 | 4/1962 | Scott | 126/190 |
| 3,159,885 | 12/1964 | Cowles | 49/493 X |
| 3,384,381 | 5/1968 | Hennessy, Jr. | 49/494 X |
| 3,404,675 | 10/1968 | Payne | 126/190 |
| 3,439,668 | 4/1969 | Tilus | 126/190 |
| 3,507,266 | 4/1970 | Vonasch | 126/190 |
| 3,810,483 | 5/1974 | Vonderhaar | 126/190 |
| 3,847,199 | 11/1974 | Meier et al. | 156/293 |
| 3,949,535 | 4/1976 | King, Jr. | 403/408 |
| 4,077,389 | 3/1978 | Vogel | 126/190 |
| 4,223,660 | 9/1980 | Lang | 49/479 X |

OTHER PUBLICATIONS

USM Catalog, Eyelets and Eyelet Assembling Equipment, Bulletin E-500-1279, undated (prior to 1980).

*Primary Examiner*—Philip C. Kannan

*Attorney, Agent, or Firm*—Harness, Dickey & Pierce

[57] ABSTRACT

An improved door seal for oven doors and the like comprising a seal having a length substantially greater than its width, having a retaining hook operably secured to each end of said seal by means of eyelets, the door having at least two spaced apart apertures between which the seal is extended by insertion of the respective retainer hooks into respective apertures. The seal may be made of an elastomeric material and the door apertures may be disposed in a manner that the seal is stretched in tension between them by said retaining hooks. More than one seal may be used, with the door seal having a multiplicity of pairs of apertures, to create a U-shaped seal or whatever desired design is selected.

15 Claims, 6 Drawing Figures

FIG. 1.
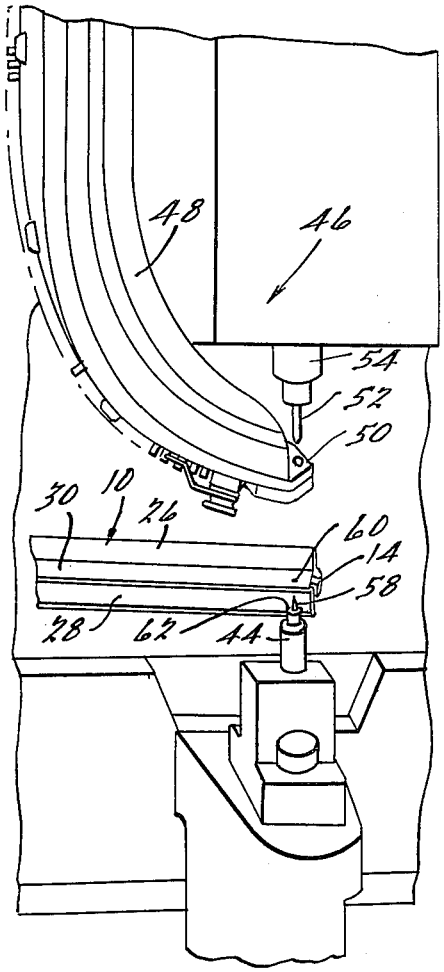
FIG. 2.
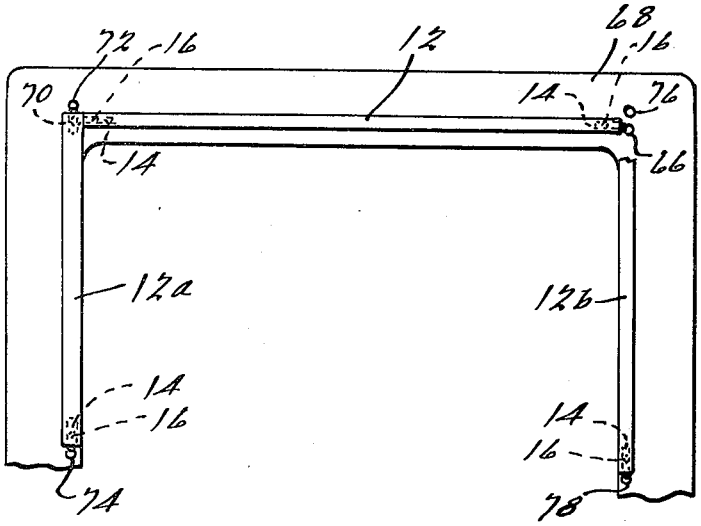
FIG. 6.
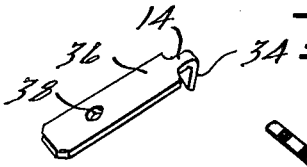
FIG. 5.
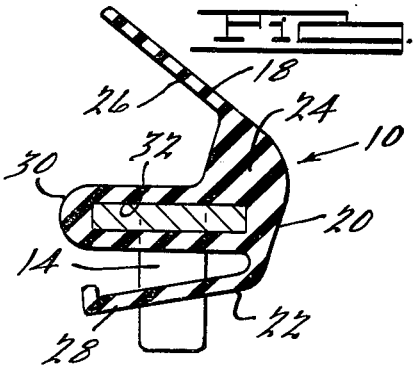
FIG. 3.
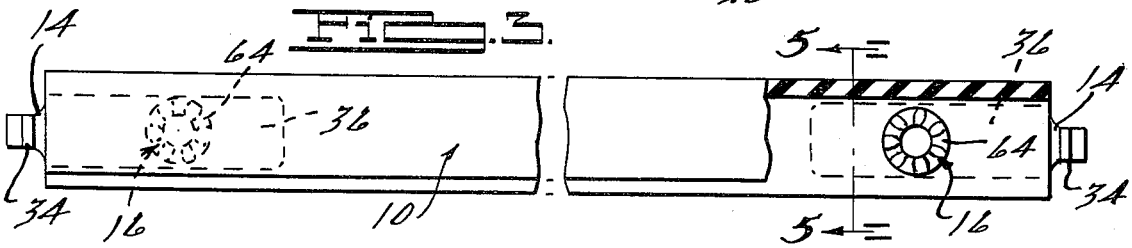
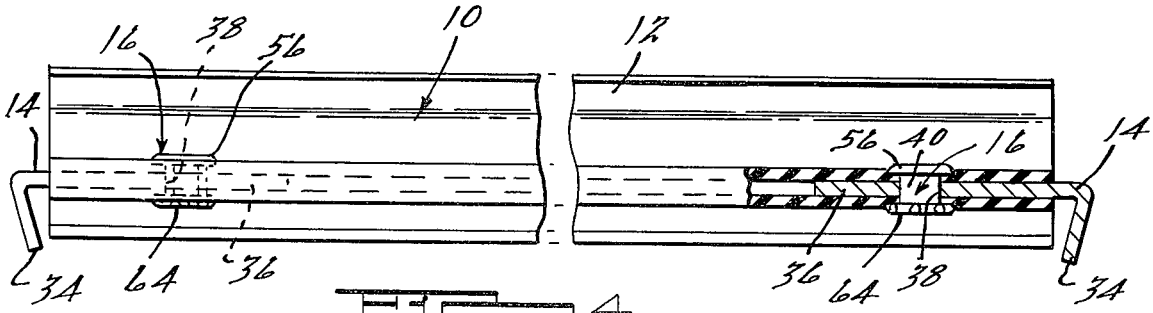
FIG. 4.

DOOR SEAL

BACKGROUND AND SUMMARY OF THE INVENTION

The present invention relates generally to door seals or gaskets and more particularly to a new and improved door seal. More specifically, the improved door seal of the present invention is to be used as a seal for oven doors, refrigerator doors, and the like wherein the seal has the feature of being easily situated onto and also readily removable from the door and, when in operation, is stretched along the surface of the door between two points of engagement under tension to create a longitudinally extending effective seal. Door seals stretched across two points engaging the door by retainer hooks have been known in the prior art. Prior art devices, however, involve many methods of securing the retainer means to the resilient seal means having several disadvantages. With one construction, reverse directed barbs are included in the body of the retainer hooks which barbs are slipped into a sleeve in the elastomeric seal to secure the retainer from releasing from the seal. This barbed construction has been unsatisfactory, however, in that the barbs tear the elastomeric material to reduce the effectiveness of the seal and also have needed relatively long body portions with respect to the hook size of the retainer hook in order to provide a multiplicity of barbs for effective holding.

Another known method of attaching the retainer to the seal is placing self-vulcanizing adhesive on the retainer or in the seal and sliding the retainer into a sleeve in the extruded silicone rubber seal. The adhesive, however, builds up around the retainer causing uneven bulky spots which affect the ability to seal at that point. In this construction, also, time is necessary for the adhesive to set and cure during which time the component can be displaced from their intended positions. The prior art retainer hooks used in such a construction again have had relatively long body portions relative to the size of the hook means involved. Also, a positive lock is not always incurred since bond failure due to variations in adhesives or improper set and cure has been known to occur. The difficulty in handling the adhesive and the expense of the adhesive are also disadvantageous, particularly in a setting in which the seals are to be mass produced.

The present invention utilizes eyelets to fasten the retainer hook through a sleeve in an extruded silicone rubber seal. The retainer hook can be smaller, use less metal, and be fastened very inexpensively to the seal in a manner very conducive to mass production. It is also believed by applicant that the eyelet creates a more consistent hold between the hook and the seal in a mass production process than the prior art cured adhesive construction as described above. Thus, the retainer hook can be smaller in size than the one held in by an adhesive. Also, because less metal is used the eyelet costs less than any satisfactory adhesive utilized in the art. And the eyelet is much easier to handle in a manufacturing process than adhesive since there is no curing cycle required during which the components can become displaced from their intended position.

Other objects and advantages of the instant invention will be apparent in the following specification, claims and drawings.

BRIEF DESCRIPTION OF THE DRAWINGS

FIG. 1 is an elevated view of an eyelet fastening tool utilized in the manufacture of the seal of the present invention;

FIG. 2 is an elevated view of the interior surface of an oven door having a seal secured thereon;

FIG. 3 is an elevated bottom view of a seal of the present invention with a portion broken away;

FIG. 4 is a side view of a seal of the present invention with a portion broken away.

FIG. 5 is a cross sectional side view of the seal of FIG. 3 taken substantially along the line 5—5 of FIG. 3; and FIG. 6 is an elevated perspective view of a retainer hook of the present invention.

DETAILED DESCRIPTION OF THE PREFERRED EMBODIMENT

Referring now in detail to the drawings and in particular to FIGS. 3 and 4 thereof, an oven door seal 10 is shown. Generally speaking, the oven door seal 10 comprises elastomeric seal 12, such as an extruded silicone rubber seal 12 as shown having a length substantially greater than its width, and a pair of retaining hooks or clips 14 fixedly secured to the seal means 12 by eyelets 16. Referring to FIG. 5, the seal has a contour to provide effective sealing and also offer a sleeve through which the retainer hook 14 can be located and engaged. The overall contour comprises external surfaces 18 and 20 and abutment surface 22 all formed by the elongated main body portion 24 of the seal 12 and outwardly extending flanges 26 and 28. Sleeve portion 30 also extends from the main body portion 24 to provide an interior sleeve 32 along the length of the seal 12. The retainer hook 14 is comprised of a hook portion 34 and a main body portion 36 in which an aperture 38 is disposed, said aperture 38 being slightly larger than the diameter of the barrel 40 of the eyelet 16.

In the manufacturing process, as shown in FIG. 1, the hook 14 is inserted in the sleeve 30 and the seal 12 is positioned such that the aperture 38 is disposed above the set die 44 of the eyelet tool 46. the feeder 48 of the tool 46 then feeds an eyelet 16 to the feed point 50 of the feeder 48. The spindle 52 passes through the barrel 40 of the eyelet 16 and the set cap 54 contacts the preformed head or flange 56 to force the eyelet 16 onto the seal 12 above the aperture 30 of the hook 14, forcing the seal 12 and hook onto the needle point portion 58 of the set die 44, piercing the seal 12. After a hole 60 is formed in the seal 12 by the needle point 58, the tool 46 is tripped to further force the eyelet 16 onto a corrugated die portion 62 of the set die 60 to create scored setting lower flange head 64 of the eyelet 16 and secure the hook 14 into the sleeve 32 of the seal 12 between the heads 56 and 64 of the eyelet 16. The process is then repeated for the opposite end of the seal means 12. In the preferred embodiment, the tool 46 is a Model WT-Eyelet Assembly Machine, as manufactured and sold by USM Corporation, Shelton, Conn. The eyelet 16 used is a USM Corporation SE45 eyelet having an outside barrel diameter of approximately 0.121 inches, a 0.156 inch barrel length, and a 0.200 inch head or preformed flange outside diameter.

It must be noted that although a scored setting lower flange head 64 is the preferred embodiment, applicant believes that a wide roll setting can be also used and in some instances other settings may be useful, all of which is within the scope of the present invention.

In operation, the seal 12 is then taken at one end and the hook 34 of the retainer hook 14 is placed in an aperture 66 in a door 68 (FIG. 2). The seal 12 is then stretched in tension and the hook 34 of the retainer hook 14 at the opposite end of the seal means 12 is inserted in an aperture 70 spaced apart from aperture 66 to stretch the seal means between the two apertures, in tension. When the two hooks are inserted in the apertures, the hooks are directed in a fashion to expose any exterior surfaces 20 and 18, and compress surface 22 and flange 28 against the sleeve portion of the main body 24. Two more seals **12*a* and 12*b* are likewise stretched across apertures 72, 74 and 76, 78, respectively. Apertures 72 and 76 are slightly offset from apertures 66 and 70, respectively, so that a squared corner as shown is provided when the seals 12, 12*a* and 12*b* are operably disposed. A continuous sealed edge is provided in a U-shaped fashion along the surface of the door 68, which is further enhanced when the door 68 is closed onto the edge of the oven opening or the like. The door and the oven are of course not material to the present invention, and it is also meant to be understood that the seals 12 might be applied to an inner door liner as well as to an oven. In FIG. 2, three seals 12 are shown detachably mounted to the door surface to provide a continuous seal. Various other combinations of seals 12**, however, can be utilized as desired by placing apertures in desired locations. The present invention is meant to also include sealing across the open portion of the U-shape either partially or entirely.

As seen from the foregoing, the present invention provides a new and improved door seal which embodies a number of features not shown in the prior art. In particular, the door seal of the present invention uses less metal, and no glue or barbs, to provide an inexpensive, continuous and effective seal.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. In combination with a door having a surface and having at least two spaced apart apertures along said surface, an improved door seal comprising means for sealing said door, retainer hook means, including a body portion and a hook portion, and eyelet means for securing said retainer hook means to said sealing means, said sealing means including sealing flange means substantially isolating said door surface from direct contact with said eyelet means, wherein said sealing means is secured to said door by said retainer hook means at said apertures.

2. A claim in accordance with claim 1, wherein said sealing means includes a sleeve and said body portion of said retainer hook means is operably disposed within said sleeve and said eyelet means secures said body portion to said sleeve to secure said retainer hook means to said sealing means.

3. A claim in accordance with claim 1, wherein said sealing means comprises an elastomeric seal having a length substantially greater than its width.

4. A claim in accordance with claim 3, wherein said seal is stretched in tension between said apertures when said retainer hook means is engaged in said apertures.

5. In combination with a door having a surface with at least two spaced apart apertures, an improved door seal comprising an elastomeric seal having a length substantially greater than its width, including a sleeve having openings at each extreme of said seal;

two retainer hooks disposed in said apertures, each including a body portion and a hook portion extending from said body portion, said body portion having an aperture therein;

two eyelets securing said hooks to said seal, each operably disposed to secure one of said hooks to said seal sleeve, each eyelet disposed in the aperture of one of said hook body portions, said sealing means including sealing flange means substantially isolating the surface of said door from directly confronting each of said eyelets.

6. A claim in accordance with claim 5, wherein each said eyelet includes a first pre-formed head portion and a second formed flange head portion and said sleeve and each hook are secured between said head portions of the respective eyelet.

7. A claim in accordance with claim 6, wherein said second formed flange head portion is a second setting flange head portion.

8. In a door assembly having a pair of relatively movable members, said members having mutually confronting surfaces, one of said members having at least one pair of apertures therein, and sealing means disposed between said confronting surfaces and being attachable to a pair of said apertures for sealing said members when said members are relatively moved into confrontation with one another, the improvement wherein said sealing means comprises:

an elastomeric seal having a length substantially greater than its width, including a sleeve having an opening in at least one extreme end of said seal;

retainer hook adapted to attachably engage each of the apertures of said door assembly, each said retainer hook including a body portion and a hook portion extending from said body portion, said body portion having an aperture therein;

fastener extending through the aperture in said body portion of each said retainer hook securing said body portion of said retainer hook to said sleeve, said fastener including a pair of fastener flanges disposed generally one at each end thereof, a portion of said sleeve being secured between each of said fastener flanges and said body portion;

said elastomeric seal further including at least one external sealing flange disposed on one side of said sleeve and extending in a generally overlapping relationship with said fastener flange, said sealing flange sealingly engaging one of said confronting surfaces and substantially isolating one of said confronting surface from directly contacting said fastener when said door assembly is closed.

9. The improvement according to claim 8, wherein said fastener includes a pair of said fastener flanges disposed on opposite sides of said sleeve, said elastomeric seal including a pair of said external sealing flanges disposed on opposite sides of said sleeve, each of said sealing flanges overlapping one of said fastener flanges, thereby substantially isolating both of said confronting surfaces from directly contacting said fastener.

10. The improvement according to claim 10, wherein said fastener comprises an eyelet including a first pre-formed flange head portion and a second formed flange head portion, said sleeve and said retainer hook being secured between said flange head portions.

11. In a door assembly including a door and a frame having confronting surfaces, means for sealing the door when closed, said means including an elongated elastomeric sealing member, at least the extreme end portions of said sealing member including an end opening therein, and a pair of retainers respectively engaged with said end portions, the improvement comprising:

an insert portion on each of said retainers, said insert portion being snugly fitted within its respective end opening in said sealing member, said insert portion having at least one aperture extending transversely therethrough, each of said retainers further including a hook portion adapted to attachably engage a retainer opening on one of said confronting surfaces;

an elongated fastener extending through the aperture in each of said insert portions, said fastener having a transverse cross-sectional shape complimentary to the transverse cross-sectional shape of said aperture, said fastener having transverse dimensions substantially equal to, but slightly less than, those of said aperture, said fastener including a fastener flange disposed generally at each end thereof, a portion of said sealing member being secured between each of said fastener flanges and said insert portion;

said sealing member including at least one external sealing flange disposed on one side thereof and extending in a generally overlapping relationship with one of said fastener flanges, said sealing flange sealingly engaging one of said confronting surfaces and substantially isolating said one confronting surface from directly contacting said fastener when said door and frame surfaces are placed in confrontation with one another.

12. The improvement according to claim 11, wherein said sealing member includes a pair of said external sealing flanges disposed on opposite sides thereof, each of said sealing flanges overlapping one of said fastener flanges, each of said sealing flanges sealingly engaging one of said confronting surfaces thereby substantially isolating both of said confronting surfaces from said fastener when said door and frame surfaces are placed in confrontation with one another.

13. The improvement according to claim 12, wherein said aperture is generally circular in shape cross-section, said fastener being generally cylindrical in shape the outer diameter of said cylindrical fastener being substantially equal to, but slightly less then, the inner diameter of said cylindrical aperture.

14. The improvement according to claim 13, wherein each of said fasteners comprises a metallic barrel-type eyelet, the outer diameter of the barrel portion of said eyelet being substantially equal to, but slightly less than, the inner diameter of said aperture.

15. In a door assembly having a pair of relatively movable members which move relatively toward one another to close said door assembly, said members having mutually confronting surfaces, one of said members having at least two apertures therein, and sealing means disposed between said confronting surfaces and being attachable to said apertures for sealing said members when said door assembly is closed, the improvement wherein said sealing means comprises:

an elastomeric seal having a length substantially greater than its width, including a sleeve having an opening in both ends of said seal;

a retainer hook adapted to attachably engage each of the apertures of said door assembly, each said retainer hook including a body portion and a hook portion extending from said body portion, said body portion having an aperture therein;

a fastener extending through the aperture in said body portion of each said retainer hook securing said body portion of said retainer hook to said sleeve, said fastener including a first pre-formed flange head portion and a second formed flange head portion, said sleeve and said retainer hook being secured between said flange head portions;

said elastomeric seal further including two external sealing flanges disposed one on each side of said sleeve and each extending in a generally overlapping relationship with said fastener flange, each said sealing flange sealingly engaging one of said confronting surfaces and substantially isolating each respective confronting surface from directly confronting said fastener when said door assembly is closed.

* * * * *

UNITED STATES PATENT AND TRADEMARK OFFICE

CERTIFICATE OF CORRECTION

PATENT NO. : 4,417,420

DATED : November 29, 1983

INVENTOR(S) : Richard B. Marsh

It is certified that error appears in the above-identified patent and that said Letters Patent is hereby corrected as shown below:

Column 2, line 44
the third occurrence of "the" should be --The--.

Column 4, line 41, claim 8 insert --a-- before the word "retainer".

Column 4, line 46, claim 8 insert --a-- before the word "fastener".

Column 5, line 1, claim 10 change "10" to --9--.

Column 6, line 7, claim 13 change "then" to --than--.

Signed and Sealed this

*Fourteenth* Day of *February 1984*

[SEAL]

*Attest:*

GERALD J. MOSSINGHOFF

*Attesting Officer*

*Commissioner of Patents and Trademarks*